United States Patent [19]

Milner et al.

[11] Patent Number: 4,497,854

[45] Date of Patent: Feb. 5, 1985

[54] ARTIFICIAL CROSS-COUNTRY SKI SURFACE WITH PAIR OF BENT OVER SKI TRACKS

[76] Inventors: Ed M. Milner, 411 Clark, Kirkwood, Mo. 63122; John R. Mykrantz, 2329 N. Ballas, St. Louis, Mo. 63131

[21] Appl. No.: 590,509

[22] Filed: Mar. 16, 1984

[51] Int. Cl.[3] ..... A01N 3/00

[52] U.S. Cl. ..... 428/17; 264/293; 428/88; 428/89

[58] Field of Search ..... 428/17, 88, 89; 264/293

[56] References Cited

U.S. PATENT DOCUMENTS

| | | | |
|---|---|---|---|
| 2,924,455 | 2/1960 | Brunel | 272/56.5 |
| 3,091,998 | 6/1963 | Wehr et al. | 94/3 |
| 3,291,486 | 12/1966 | Applegath et al. | 272/56.5 |
| 3,400,643 | 9/1968 | Holley | 94/3 |
| 3,547,749 | 12/1970 | White et al. | 161/63 |
| 3,570,846 | 3/1971 | Weber et al. | 272/56.5 |
| 3,574,107 | 4/1971 | Hurka | 161/67 |
| 3,576,698 | 4/1971 | Chidgey et al. | 161/21 |
| 3,731,923 | 5/1973 | Greene | 272/56.5 |
| 3,821,064 | 6/1974 | Cima | 428/89 |
| 3,959,542 | 5/1976 | Livermore | 428/89 |

*Primary Examiner*—Marion E. McCamish

*Attorney, Agent, or Firm*—Senniger, Powers, Leavitt and Roedel

[57] ABSTRACT

An artificial surface for simulated cross-country skiing comprising an elongate flat flexible base and a multiplicity of extruded strips of synthetic resin material forming relatively stiff smooth-surfaced blade-like members secured to and substantially covering one face of the base. The blade-like members project generally perpendicularly from the base except in two generally parallel spaced-apart zones extending longitudinally of the base where the blade-like members are bent over in one direction extending generally lengthwise of the base to provide a pair of generally parallel ski tracks along the base. The base is adapted to be placed on the ground with the blade-like members facing upwardly and the bent-over blade-like members pointing in a direction opposite the direction of ski movement along said tracks.

A method of making the artificial surface, and a method of using it are also disclosed.

19 Claims, 9 Drawing Figures

ARTIFICIAL CROSS-COUNTRY SKI SURFACE WITH PAIR OF BENT OVER SKI TRACKS

BACKGROUND OF THE INVENTION

This invention relates generally to an artificial ski surface and, more particularly, to an artificial surface especially adapted for simulated cross-country skiing.

The sport of cross-country skiing is becoming increasingly popular, both in schools and among sports-minded people in general. Consequently there is an increasing demand for an artificial ski surface which is versatile enough to be used for introductory cross-country ski classes, for training by those proficient in the sport during the off-season, and for general sports and leisure purposes.

Reference may be made to U.S. Pat. Nos. 3,547,749, 3,576,698, 3,731,923, 3,570,846, 3,574,107, 3,400,643, 3,291,486, 2,924,455, 3,091,998, most of which show a variety of artificial surfaces adapted for use in downhill skiing.

SUMMARY OF THE INVENTION

Among the several objects of this invention may be noted the provision of an artificial cross-country ski surface; the provision of such a surface which closely simulates the sliding characteristics of a natural snow surface; the provision of such a surface which insures straight sliding; the provision of such a surface which permits the use of conventional ski equipment without damage to the equipment; the provision of such a surface which is durable; the provision of such a surface which is simple in construction, light in weight and easy to apply to ground surfacing; the provision of an efficient method of making the aforementioned artificial surface; and the provision of a method of simulating cross-country skiing utilizing the aforementioned artificial surface.

Generally, an artificial surface of the present invention for simulated cross-country skiing comprises an elongate flat flexible base and a multiplicity of extruded strips of synthetic resin material forming relatively stiff smooth-surfaced blade-like members secured to and substantially covering one face of the base. The blade-like members project generally perpendicularly from said one face of the base except in two generally parallel spaced-apart zones extending longitudinally of the base. In these zones the blade-like members are bent over in one direction extending generally lengthwise of the base to provide a pair of ski tracks along the base. The bent-over blade-like members have outer end portions angling away from the base and terminating in tips pointing in said one direction. The base is adapted to be placed on the ground with the blade-like members facing upwardly and the bent-over blade-like members pointing in a direction opposite the direction of ski movement along said tracks.

The present invention further involves a method of simulating cross-country skiing comprising (a) providing an artificial surface of the type comprising an elongate flat flexible base and a multiplicity of extruded strips of synthetic resin material forming relatively stiff smooth-surfaced blade-like members secured to and substantially covering one face of the base, said blade-like members projecting generally perpendicularly from said one face of the base except in two generally parallel spaced-apart zones extending longitudinally of the base where the blade-like members are bent-over in one direction extending generally lengthwise of the base to provide a pair of generally parallel ski tracks along the base, said bent-over blade-like members having outer end portions angling away from the base and terminating in tips pointing in said one direction, and (b) installing the artificial surface to lay on the ground with the bent-over blade-like members oriented with their outer end portions pointing in a direction opposite to the direction of ski movement along said tracks.

The present invention also involves a method of manufacturing the aforesaid artificial surface, comprising (a) providing an artificial surface of the type comprising an elongate flat flexible base and a multiplicity of extruded strips of synthetic resin material forming relatively stiff smooth-surfaced blade-like members secured to and substantially covering one face of the base, the blade-like members projecting generally perpendicularly from said one face of the base, (b) applying a bending force to said blade-like members in two generally parallel spaced-apart zones extending longitudinally of the base, and (c) heating the blade-like members while applying said bending force to give such members a permanent directional bend in one direction extending generally lengthwise of the base to form two generally parallel spaced-apart ski tracks along the base.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF PREFERRED EMBODIMENTS

Figure 1:
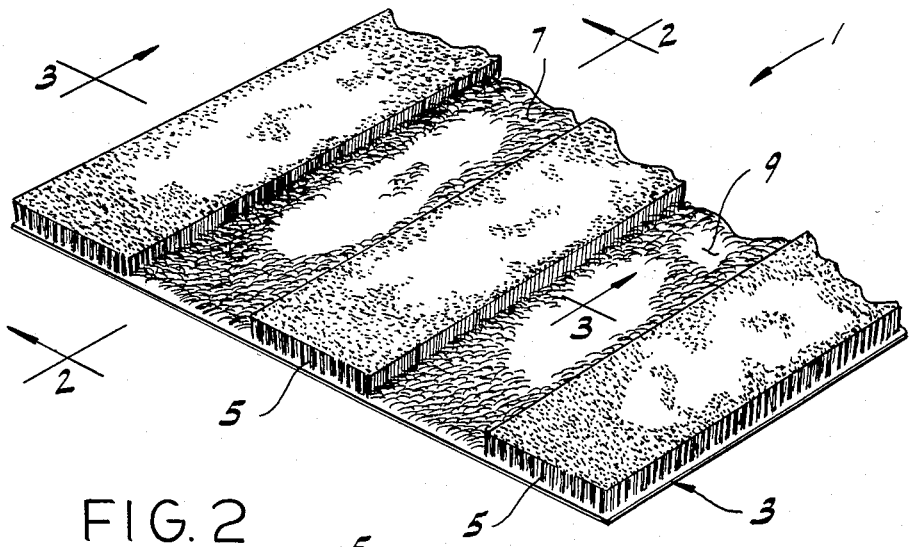
FIG. 1 is a perspective of the artificial cross-country ski surface of this invention.

Referring now to the drawings, and first more particularly to FIG. 1, there is generally indicated at 1 an artificial surface especially adapted for simulated cross-country skiing. As shown, the surface comprises an elongate flat flexible base generally designated 3 and a multiplicity of extruded strips of synthetic resin material (e.g., polypropylene or polyethylene) forming relatively stiff smooth-surfaced blade-like members 5 secured to and substantially covering one face (the upper face as shown) of the base. These blade-like members 5 project generally perpendicularly upwardly from the base except in two generally parallel spaced-apart zones 7, 9 extending generally longitudinally of the base. In these zones the blade-like members are bent over in a direction extending generally lengthwise of the base to provide a pair of generally parallel ski tracks along the base.

Figure 4:
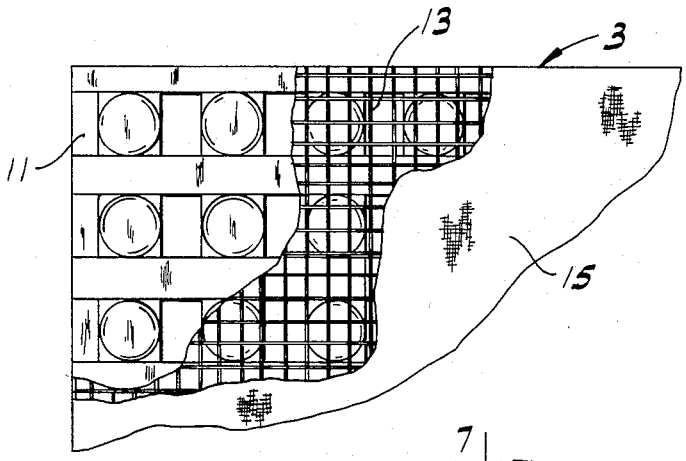
FIG. 4 is an enlarged bottom plan of a portion of the ski surface, portions being broken away to illustrate the construction of the surface.

As illustrated in FIG. 4, the base 1 of the artificial surface 1 is a laminate comprising a top layer 11 constituted by an integrally formed lattice of synthetic resin material (e.g., polypropylene or polyethylene), a central layer 13 of suitable reinforcing mesh (e.g., nylon mesh) partially enbedded in the top layer 11, and a bottom or backing layer 15 of non-slip gauze-type material bonded to the top plastic layer 11 through the openings in the mesh layer 13.

The blade-like members 5 are constituted by flat narrow lengths of extruded plastic resembling natural blades of grass. They are clustered in groups or tufts arrayed in transverse and longitudinal row alignment with respect to the base. Each tuft includes a plurality (e.g., eight) of blade-like members integrally joined at their lower ends in circular formation to the top plastic layer 11 of the base. The tufts in each row may be spaced $\frac{3}{8}$ inch apart, for example, and the blade-like members 5 may range from $\frac{1}{2}$ inch to $1\frac{1}{8}$ inches long, depending on whether they are located in or out of zones 7 and 9. It will be noted in this regard that in the preferred embodiment the bent-over blade-like members are shorter (as measured along their lengths) than the upstanding blade-like members outside of zones 7 and 9. For example, the bent-over blade-like members may be $\frac{1}{2}$ inch–$\frac{3}{4}$ inch long (and preferably about $\frac{5}{8}$ inch long), and the upstanding blade-like members $\frac{3}{4}$ inch–$1\frac{1}{8}$ inches long (and preferably about 1 inch long).

Figure 2:
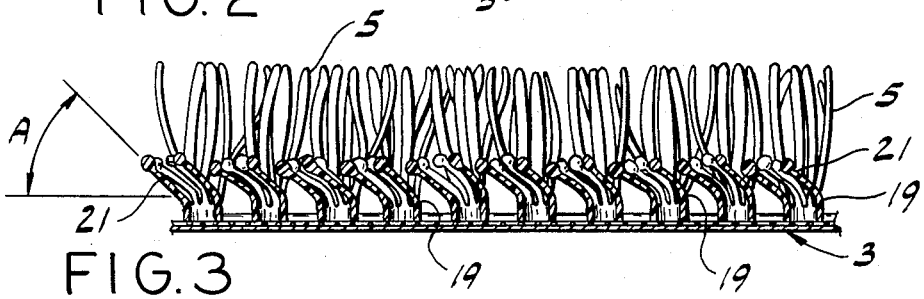
FIG. 2 is an enlarged vertical section on line 2—2 of FIG. 1.

The blade-like members 5 in zones 7 and 9 forming the two ski tracks are bent to have the configuration shown in FIG. 2. As illustrated therein, each blade has a curved lower end portion 19 and an upper end portion 21 which angles upwardly with respect to the base and which terminates in a tip which points longitudinally with respect to a respective zone 7, 9. The angle (designated "A" in FIG. 2) at which the upper blade portion extends relative to the base may range from 30°–60°, and is preferably about 45°. The tips of the bent-over blade-like members 5 are enlarged and have rounded nubs 23 thereon, which are advantageous in that they tend to minimize any adherence between the blade-like members and the bottom surfaces of skis gliding thereover.

Each of the zones 7 and 9 constituting a ski track is preferably about $3\frac{1}{4}$ inches wide (slightly wider than a conventional cross-country ski) and the center-to-center spacing between the tracks is about 8 inches, which is the standard spacing in the sport. The artificial surface should also have an overall width (e.g., 18 inches) sufficient to accommodate the use of ski poles, the latter of which should be engageable with the artificial surface in the areas outside of the tracks 7, 9 adjacent the sides of the artificial surface. The artificial surface 1 may be manufactured in suitable lengths (e.g., 15–30 meter lengths, and preferably in about 16 meter lengths).

Figure 3:
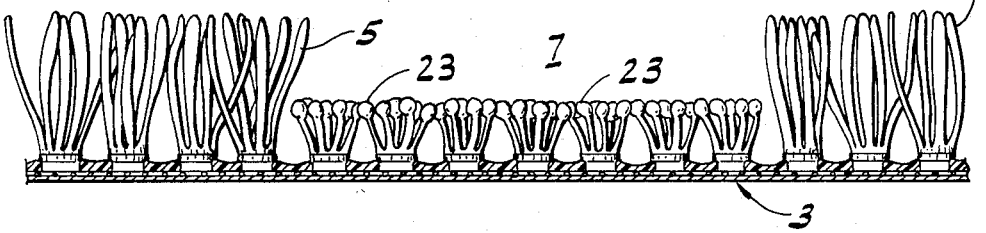
FIG. 3 is an enlarged vertical section on line 3—3 of FIG. 1.
Figure 5:
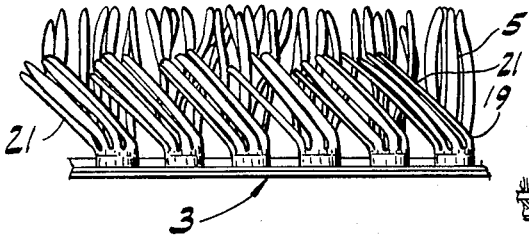
FIG. 5 is a view similar to FIG. 2 showing an alternate design of the ski surface.

FIG. 5 illustrates another embodiment of the artificial surface wherein the tips of the bent-over blade-like members 5 in ski tracks 7, 9 are not enlarged (e.g., melted) as in the FIG. 1–3 design. In this version the upstanding (generally perpendicular) blade-like members and the bent-over blade-like members are approximately of the same length (as measured along their lengths). For example, the blade-like members may be from $\frac{3}{4}$ inch–$1\frac{1}{8}$ inches long, and preferably about 1 inch long. Alternatively, the bent-over blade-like members may be shorter (e.g., $\frac{5}{8}$ inch) than the blade-like members outside of zones 7 and 9.

Figure 6:
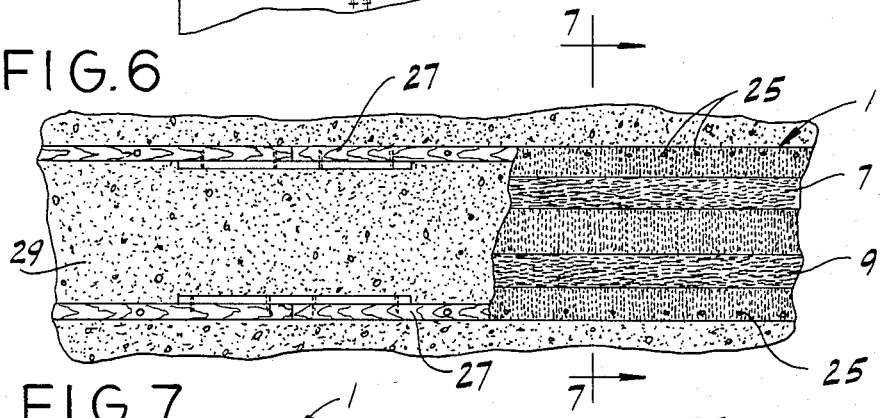
FIG. 6 is a top plan of the artificial surface as installed on the ground, portions being broken away to illustrate details.
Figure 7:
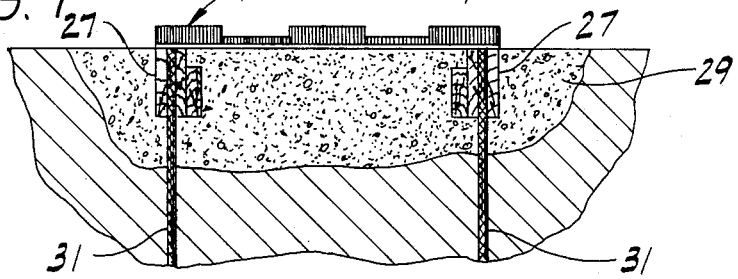
FIG. 7 is a vertical section on line 7—7 of FIG. 6.

FIGS. 6 and 7 illustrate one way in which the artificial surface 1 may be installed. As depicted, the artificial surface is secured at its side margins by suitable fasteners 25 (e.g., galvanized roofing nails) to side rails 27 embedded in a bed 29 of gravel. The side rails are secured in place by reinforcing bars or rods 31 extending down through the rails into the ground below bed 29.

Figure 8:
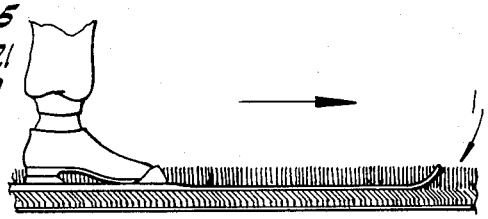
FIG. 8 is a cross-sectional view taken longitudinally of the ski surface illustrating the preferred method of skiing on the surface.

In accordance with the present invention, the artificial surface 1 is adapted to be installed to lay on the ground with the bent-over blade-like members 5 oriented with their outer end portions 21 pointing in a direction opposite to the direction of movement of skis 32 along the tracks 7, 9 (see FIG. 8). It is believed that installation in this manner for skiing "against the grain" of the surface tends to further minimize adherence between the skis and the artificial surface. It will be understood, however, that the surface 1 may also be installed for skiing "with the grain" (i.e., in the same direction as the direction of bend) without departing from the scope of this invention.

Figure 9:
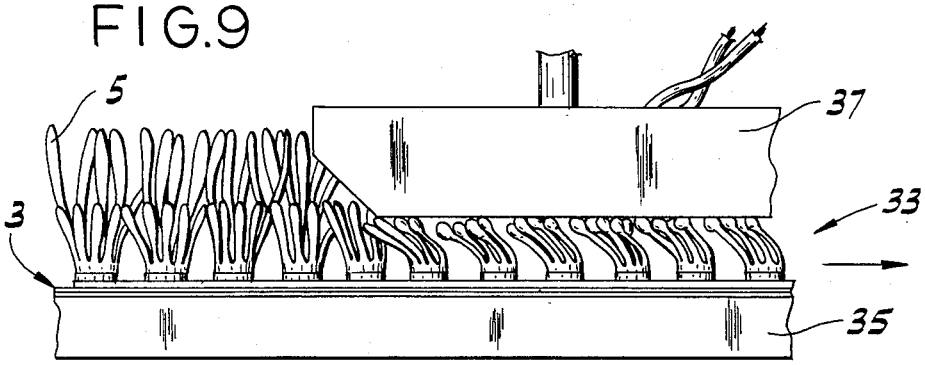
FIG. 9 is a view illustrating a method of making the artificial surface of FIG. 1.

FIG. 9 illustrates a method of manufacturing the artificial cross-country ski surface 1. The surface may be made from a continuous strip of artificial turf of a type produced generally in accordance with the continuous injection molding process described in U.S. Pat. No. 3,576,698 (owned by Monsanto Company of St. Louis, Mo.), with the exception that the reinforcing mesh layer 13 of the base 3 is preferably of a suitable synthetic resin material (e.g., nylon) instead of metal as disclosed in the patent. Artificial turf of this general type is sold under the trademark "AstroTurf" (product code CH-4) by Monsanto Company. In the preferred embodiment of the present invention (FIG. 1–3), the blade-like members 5 in zones 7 and 9 are extruded in the manner described in said patent to have lengths less than the lengths of the blade-like members outside of such zones. In the embodiment of FIG. 5, the blade-like members in and out of zones 7 and 9 are extruded to approximately the same length (e.g., 1").

In accordance with the method of the present invention, a continuous strip 33 of artificial turf formed in the above-described manner is pulled along a table 35 past a pair of generally parallel spaced-apart horizontal heating elements or bars 37 (only one shown) mounted above the table. The bars have widths corresponding to the desired widths of the ski tracks 7, 9 and are engageable with the blade-like members 5 in parallel zones 7 and 9 for applying a bending force to such members while heating them to give the members 5 in such zones a permanent bend in one direction extending generally lengthwise of the strip 33 to form the two ski tracks 7, 9. To produce the artificial surface shown in FIGS. 1–3, the temperature of the heating bars 37 and the rate at which the strip of turf is pulled therepast should be such that the tips of the blade-like members 5 in zones 7 and 9 are melted. The temperature to which the bars 37 must be heated to make the ski surface shown in FIG. 5 (where the tips of the blade-like members are not melted) will be less (e.g., 180° F.) than the temperatures (e.g., 375°–450° F.) involved in making the FIGS. 1–3 version.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. An artificial surface for simulated cross-country skiing comprising an elongate flat flexible base and a multiplicity of extruded strips of synthetic resin material forming relatively stiff smooth-surfaced blade-like members secured to and substantially covering one face of the base, said blade-like members projecting generally perpendicularly from said one face of the base except in two generally parallel spaced-apart zones extending longitudinally of the base, said blade-like members in said zones being bent over in one direction extending generally lengthwise of the base to provide a pair of generally parallel ski tracks along the base, said bent-over blade-like members having outer end portions angling away from the base and terminating in tips pointing in said one direction, said base being adapted to be placed on the ground with said blade-like members facing upwardly and said bent-over blade-like members pointing in a direction opposite the direction of ski movement along said tracks.

2. An artificial surface as set forth in claim 1 wherein, as measured along the lengths of said blade-like members, the generally perpendicular blade-like members are longer than the bent-over blade-like members.

3. An artificial surface as set forth in claim 2 wherein the generally perpendicular blade-like members are approximately 30% longer than the bent-over blade-like members.

4. An artificial surface as set forth in claim 3 wherein the bent-over blade-like members are from $\frac{1}{2}$ inch–$\frac{3}{4}$ inch long and the generally perpendicular blade-like members are from $\frac{3}{4}$ inch–$1\frac{1}{8}$ inches long.

5. An artificial surface as set forth in claim 4 wherein the bent-over blade-like members are about $\frac{5}{8}$ inch long and the generally perpendicular blade-like members are about 1 inch long.

6. An artificial surface as set forth in claim 1 wherein the perpendicular and bent-over blade-like members are approximately of the same length as measured along their lengths.

7. An artificial surface as set forth in claim 6 wherein said blade-like members are from $\frac{3}{4}$ inch–$1\frac{1}{8}$ inches long.

8. An artificial surface as set forth in claim 7 wherein said blade-like members are about 1 inch long.

9. An artificial surface as set forth in claim 1 wherein the outer end portions of said bent-over blade-like members extend at an angle of from 30°–60° with respect to the base.

10. An artificial surface as set forth in claim 9 wherein the outer end portions of said bent-over blade-like members extend at about a 45° angle with respect to the base.

11. An artificial surface as set forth in claim 1 wherein the tips of said bent-over blade-like members are enlarged.

12. An artificial surface as set forth in claim 11 wherein the tips of said bent-over blade-like members have rounded nubs formed thereon.

13. An artificial surface as set forth in claim 1 wherein said base has a non-slip backing thereon.

14. A method of simulating cross-country skiing comprising:

providing an artificial surface of the type comprising an elongate flat flexible base and a multiplicity of extruded strips of synthetic resin material forming relatively stiff smooth-surfaced blade-like members secured to and substantially covering one face of the base, said blade-like members projecting generally perpendicularly from said one face of the base except in two generally parallel spaced-apart zones extending longitudinally of the base, said blade-like members in said zones being bent-over in one direction extending generally lengthwise of the base to provide a pair of generally parallel ski tracks along the base, said bent-over blade-like members having outer end portions angling away from the base and terminating in tips pointing in said one direction; and installing said artificial surface to lay on the ground with said bent-over blade-like members oriented with their outer end portions pointing in a direction opposite to the direction of ski movement along said tracks.

15. A method as set forth in claim 14 further comprising skiing along said artificial surface in said opposite direction.

16. A method of manufacturing an artificial surface for simulated cross-country skiing comprising the steps of:

providing an artificial surface of the type comprising an elongate flat flexible base and a multiplicity of extruded strips of synthetic resin material forming relatively stiff smooth-surfaced blade-like members secured to and substantially covering one face of the base, said blade-like members projecting generally perpendicularly from said one face of the base;

applying a bending force to said blade-like members in two generally parallel spaced-apart zones extending longitudinally of the base;

heating the blade-like members in said zones while applying said bending force to give such members a permanent directional bend in one direction extending generally lengthwise of the base to form two generally parallel spaced-apart ski tracks along the base.

17. A method as set forth in claim 16 further comprising heating said blade-like members in said zones to melt the tips thereof and thereby form nubs at the outer ends of the blade-like members.

18. A method as set forth in claim 16 wherein said bending force is applied and said blade-members in said zones are heated by pulling said base with the blade-like members thereon past a pair of generally parallel spaced-apart heating elements, the heating elements being engageable with the blade-like members in said zones for applying said bending force to said blade-like members while heating them.

19. A method as set forth in claim 18 wherein said heating elements are adapted for heating said blade-like members to a temperature sufficient to melt the tips thereof to form nubs at the outer ends of the blade-like members.

* * * * *